US011412818B1

(12) United States Patent
Skolnik

(10) Patent No.: US 11,412,818 B1
(45) Date of Patent: Aug. 16, 2022

(54) RETAINER ASSEMBLY FOR A KNOT

(71) Applicant: Lawrence Skolnik, Chatsworth, CA (US)

(72) Inventor: Lawrence Skolnik, Chatsworth, CA (US)

( * ) Notice: Subject to any disclaimer, the term of this patent is extended or adjusted under 35 U.S.C. 154(b) by 0 days.

(21) Appl. No.: 17/158,568

(22) Filed: Jan. 26, 2021

(51) Int. Cl.
*A43C 7/00* (2006.01)
*A43C 7/04* (2006.01)

(52) U.S. Cl.
CPC ..... *A43C 7/005* (2013.01); *A43C 7/04* (2013.01); *Y10T 24/3705* (2015.01); *Y10T 24/3716* (2015.01)

(58) Field of Classification Search
CPC .. A43C 7/00; A43C 7/04; A43C 7/005; Y10T 24/3713; Y10T 24/3708; Y10T 24/3705; Y10T 24/3716
See application file for complete search history.

(56) References Cited

U.S. PATENT DOCUMENTS

| | | | | |
|---|---|---|---|---|
| 159,325 | A | 2/1875 | Hubbell | |
| 500,497 | A | 6/1893 | Hathaway | |
| 575,412 | A | 1/1897 | Bloom | |
| 886,792 | A | 5/1908 | Gayton | |
| 920,764 | A | 5/1909 | Lawrence | |
| 1,049,158 | A | 12/1912 | Shawver | |
| 1,104,259 | A | 7/1914 | Gwirtz | |
| 1,565,045 | A | 12/1925 | Bensch | |
| 2,035,174 | A * | 3/1936 | Mcilhenny | A43C 7/005 24/712.6 |
| 2,164,123 | A * | 6/1939 | Rio | A43C 7/04 24/712.5 |
| 2,877,526 | A | 3/1959 | Simpson | |
| 3,057,029 | A * | 10/1962 | Miller, Jr. | A43C 7/04 24/712.6 |
| 4,520,537 | A | 6/1985 | Valikov | |
| 4,774,743 | A | 10/1988 | Ziemelis | |
| 4,949,437 | A | 8/1990 | Anderson | |
| 5,231,740 | A | 8/1993 | Mohebkhosravi | |
| 7,152,286 | B2 | 12/2006 | Rooney et al. | |
| 2003/0051317 | A1 | 3/2003 | Preziosi et al. | |
| 2006/0053601 | A1 * | 3/2006 | Taylor | A43C 7/04 24/712.1 |
| 2008/0040963 | A1 | 2/2008 | Ochs et al. | |
| 2009/0172929 | A1 | 7/2009 | Hwang | |
| 2010/0218349 | A1 | 9/2010 | Whang | |
| 2011/0088229 | A1 * | 4/2011 | Simmons | A43C 7/005 24/712.2 |

FOREIGN PATENT DOCUMENTS

| | | |
|---|---|---|
| EP | 2127550 B1 | 11/2013 |
| FR | 3083056 A1 | 1/2020 |

* cited by examiner

*Primary Examiner* — Robert Sandy
*Assistant Examiner* — Michael S Lee
(74) *Attorney, Agent, or Firm* — Concept IP LLP; Pejman Yedidsion

(57) ABSTRACT

A retainer assembly for securing a knot defined by a pair of shoelaces of a shoe includes a base member, a clamping member, and a clip member. The clamping member is engaged with the base member and telescopically moves relative to the base member between an extended position and a retracted position. The clamping member includes a clasp. Moreover, the clip member is pivotally coupled to the base member and is adapted to engage with the clasp when the clamping member is arranged in the retracted position to secure the knot between the clip member and the clamping member.

19 Claims, 9 Drawing Sheets

RETAINER ASSEMBLY FOR A KNOT

TECHNICAL FIELD

Embodiments relate generally to a retainer assembly, and more particularly to a retainer assembly adapted to be attached to a knot of a pair of shoelaces of a shoe to secure and hold the knot together.

BACKGROUND

Shoes generally includes a pair of shoelaces to fasten the shoe onto the foot of the wearer so as to enable the wearer to tighten the shoe with the foot of the wearer. Conventionally, the shoelaces are tightened in a desired tension by pulling the shoelaces and then tying the shoelaces into knot. However, the knot can often become inadvertently untied. Once untied, the tension in the shoelace is released, causing the shoe to loosen on the foot of the wearer. Having a shoelace become undone is undesirable. A common preventive measure is to tie a double knot. This, however, complicates intentional untying of the knot.

SUMMARY

A system embodiment includes a retainer assembly for securing a knot defined by a pair of shoelaces of a shoe. The retainer assembly includes a base member, a clamping member, and a clip member. The clamping member is engaged with the base member and is adapted to telescopically move relative to the base member between an extended position and a retracted position. Further, the clamping member includes a clasp. Moreover, the clip member is pivotally coupled to the base member and is adapted to engage with the clasp when the clamping member is arranged in the retracted position to secure the knot between the clip member and the clamping member.

Another system embodiment includes a retainer assembly for securing a knot defined by a pair of shoelaces of a shoe. The retainer assembly includes a base member, a clamping member, and a clip member. The base member includes a plate and at least one engagement structure defining a laterally extending hole. Further, the clamping member is engaged with the base member and is adapted to telescopically move relative to the base member between an extended position and a retracted position. Moreover, the clamping member includes a base plate, and a pair of wings extending outwardly of the base plate in a lateral direction. Each wing defines an elongated channel extending in a longitudinal direction to slidably receive the plate and supports the plate. Also, the clamping member includes a clasp connected to the base plate. Furthermore, the clip member is pivotally coupled to the base member and includes a pair of pins arranged inside the hole to facilitate the pivotal coupling of the clip member relative to the base member. The clip member also includes an arm adapted to engage with the clasp when the clamping member is arranged in the retracted position to secure the knot between the clip member and the clamping member.

BRIEF DESCRIPTION OF THE DRAWINGS

The components in the figures are not necessarily to scale, emphasis instead being placed upon illustrating the principals of the invention. Like reference numerals designate corresponding parts throughout the different views. Embodiments are illustrated by way of example and not limitation in the figures of the accompanying drawings, in which.

DETAILED DESCRIPTION

The present system allows for securing and holding of a knot of a pair of shoelaces of a shoe.

Figure 1:
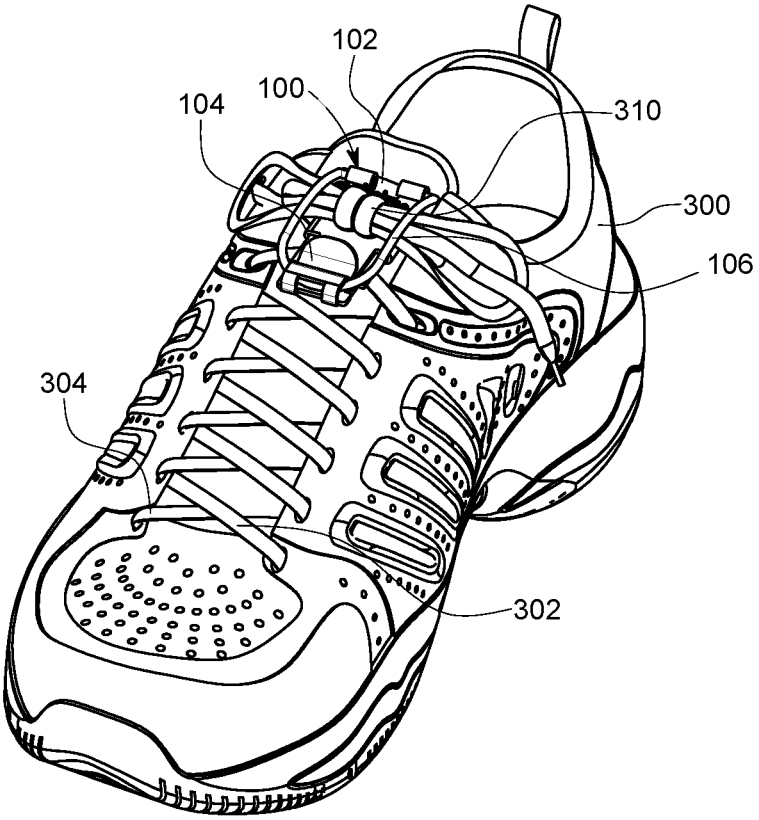
FIG. 1 depicts a retainer assembly attached to a knot of a pair of shoelaces of a shoe, according to an embodiment of the disclosure.
Figure 2:
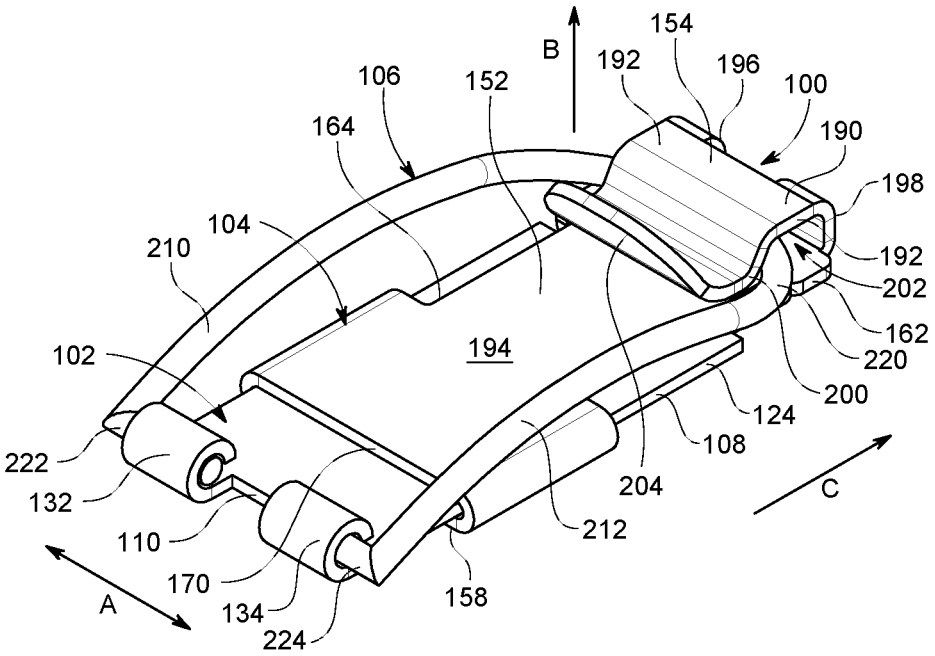
FIG. 2 depicts a top perspective view of the retainer assembly having a clamping member arranged in a retracted position, according to an embodiment of the disclosure.
Figure 3:
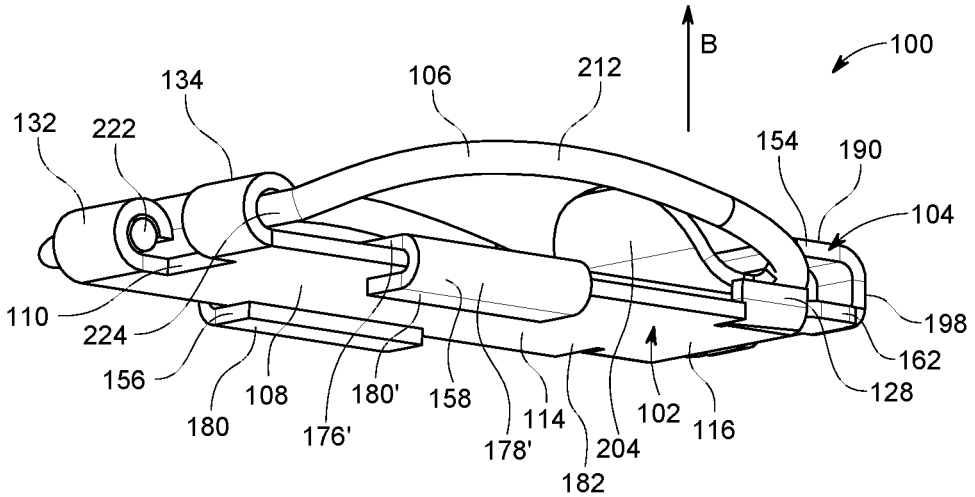
FIG. 3 depicts a bottom perspective view of the retainer assembly of FIG. 2, according to an embodiment of the disclosure.
Figure 4:
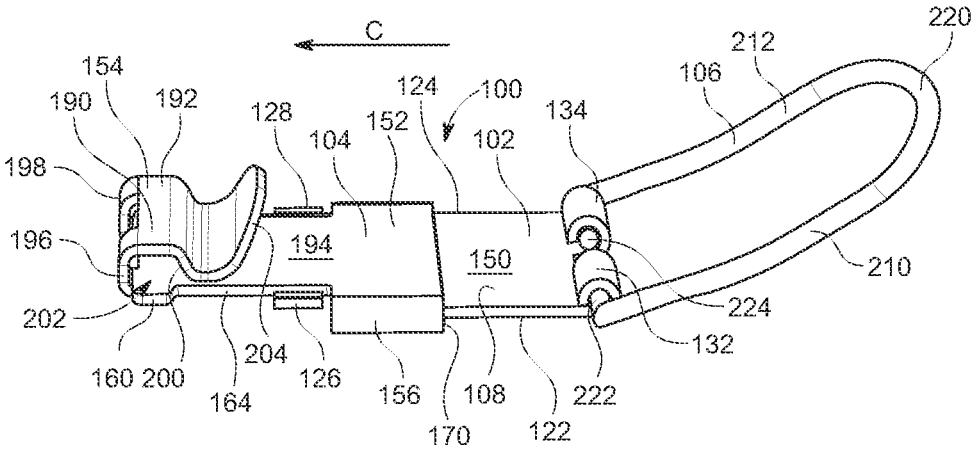
FIG. 4 depicts the retainer assembly with the clamping member arranged in an extended position, according to an embodiment of the disclosure.
Figure 5:
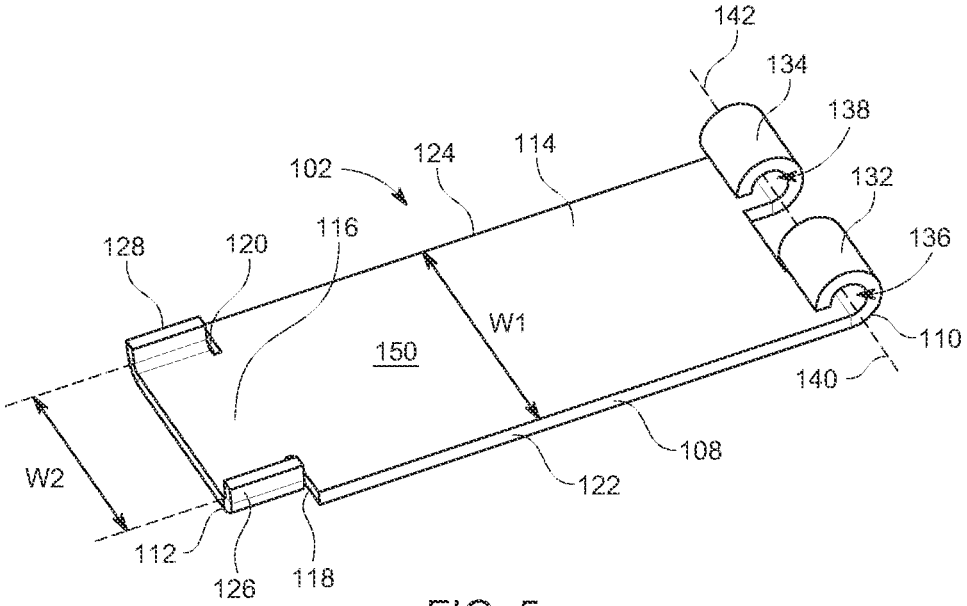
FIG. 5 depicts a top perspective view of a base member of the retainer assembly, according to an embodiment of the disclosure.
Figure 6:
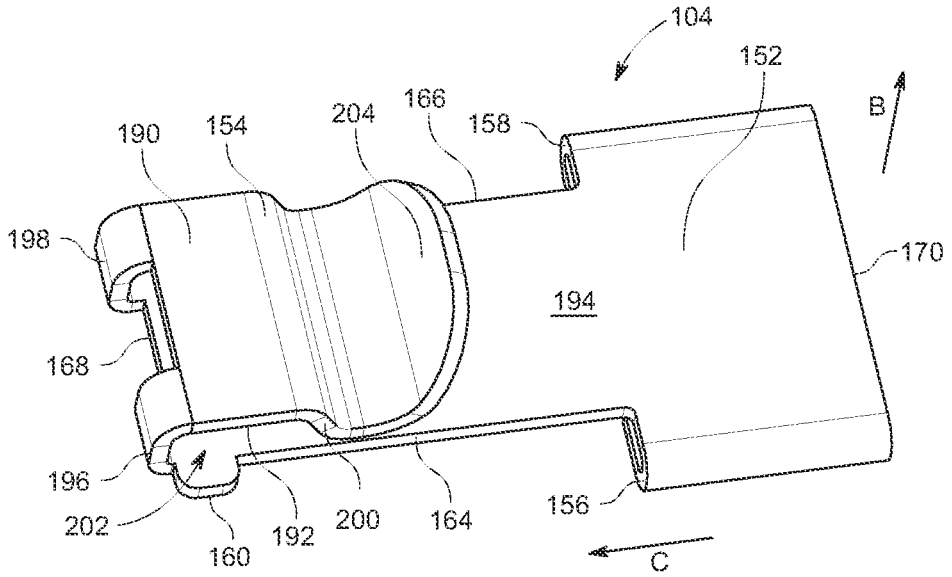
FIG. 6 depicts a top perspective view of the clamping member, according to an embodiment of the disclosure.

Referring to FIG. 1, a retainer assembly 100 engaged/secured to a knot 310 of a pair of shoelaces 302, 304 of a shoe 310 is shown. The retainer assembly 100 is configured to secure and hold the knot 310 together. Referring to FIGS. 1 to 4, the retainer assembly 100 includes a base member 102, a clamping member 104 attached to the base member 102 and adapted to telescopically slide relative to the base member 102 between an extended position (shown in FIG. 4) and a retracted position (shown in FIGS. 1 to 3), and a clip member 106 pivotally coupled to the base member 102. As shown in FIGS. 2 to 5 the base member 102 includes a plate 108 having a first longitudinal end 110, a second longitudinal end 112, a first portion 114 extending from the first longitudinal end 110 towards the second longitudinal end 112, and a second portion 116 extending from the first portion 114 to the second longitudinal end 112. In an embodiment, a width 'W1' of the first portion 114 is greater than a width 'W2' of the second portion 116, thereby defining a pair of steps 118, 120 (best shown in FIG. 5) at an interface of the first portion 114 and the second portion 116. Accordingly, a first step 118 of the pair of steps 118, 120 is disposed at a first longitudinal side 122 of the plate 108 and a second step 120 is arranged at a second longitudinal side 124 of the plate 108. Further, the base member 102 includes a pair of sidewalls (best shown in FIG. 5), for example, a first sidewall 126 and a second sidewall 128, extending along a length of the second portion 116 and extending outwardly and perpendicularly from the second portion 116 of the plate 108. As shown, the first sidewall 126 and the second sidewall 128 are arranged on the longitudinal sides 122, 124 of the plate 108, and therefore are disposed spaced apart and substantially parallel to each other. As shown in FIGS. 2 to 4, the first sidewall 126 and the second sidewall 128 abut/contact the clamping member 104 and prevents/restricts a movement of the clamping member relative to the base member 102 in a lateral direction 'A'.

Further, the base member 102 includes at least one engagement structure, for example, a first engagement structure 132 and a second engagement structure 134, arranged at the first longitudinal end 110 of the plate 108 and connected to the plate 108. As shown, the first engagement structure 132 may include a cylindrical body defining a through hole 136 to receive a portion of clip member 106 and facilitates the pivotal coupling of the clip member 106 with the base member 102. Similarly, the second engagement structure 134 may include a cylindrical body defining a through hole 138 to receive a portion of clip member 106 and facilitates the pivotal coupling of the clip member 106 with the base member 102. As shown, the clip member 106 pivots about central axes 140, 142 of each of the engagement structures 132, 134. As such, the first engagement structure 132 extends in a lateral direction from the first longitudinal side 122 of the plate 108, while the second engagement structure 134 extends in the lateral direction from the second longitudinal side 124 of the plate 108 towards the first engagement structure 132. As shown, the first engagement structure 132 is aligned with the second engagement structure 134 and may be disposed at a distance from the second engagement structure 134 such that a lateral gap exists between the facing ends of the engagement structures 132, 134. Accordingly, the engagement structures 132, 134 are arranged such that central axes 140, 142 of the engagement structures 132, 134 are aligned with each other and is arranged vertically above from a first surface 150 of the plate 108. Although two engagement structures 132, 134 are shown and contemplated, it may be appreciated that the base member 102 may include only a single engagement structure. In such a case, the engagement structure may extend along an entire width of the plate 108 and extends from the first longitudinal side 122 to the second longitudinal side 124. In an assembly of the base member 102 with the clamping member 104, the second portion 116 remains underneath the clamping member 104, while at least a portion of the first portion 114 is arranged underneath the clamping member 104. Also, in the assembly, the engagement structures 132, 134 are disposed away from the clamping member 104 and a portion of the engagement structures 132, 134 extend upwardly of the clamping member 104.

Referring to FIGS. 2, 3, 4, 6, and 7, the clamping member 104 includes a base plate 152, a clasp 154, and a pair of wings 156, 158 (best shown in FIGS. 6 and 7), and is adapted to slide between the retracted position (shown in FIGS. 1 to 3) and the extended position (shown in FIG. 4). In the extended position, the wings 156, 158 are arranged proximate to the sidewalls 126, 128 and may abut the sidewalls 126, 128. Accordingly, the sidewalls 126, 128 and the wings 156, 158 cooperate with each other to restrict/limit an extension of the clamping member 104 relative to the base member 102. Moreover, in the retracted position (as shown in FIGS. 2 and 3), the wings 156, 158 may be arranged relatively away from the sidewalls 126, 128. As such, in the retracted position of the clamping member 104, the sidewalls 126, 128 may contact a pair of shoulders 160, 162 of the clamping member 104, thereby restricting/limiting a retraction of the clamping member 104 relative to the base member 102. As shown, each of the pair of shoulders 160, 162 extends outwardly in the lateral direction 'A' from the respective longitudinal sides 164, 166 of the base plate 152. The shoulders 160, 162 are arranged proximate to a second longitudinal end 166 of the of the base plate 152, while the pair of wings 156, 158 are arranged proximate to a first longitudinal end 170 of the base plate 152 and may extend in a longitudinal direction from the first longitudinal end 170 towards the second longitudinal end 168.

Figure 7:
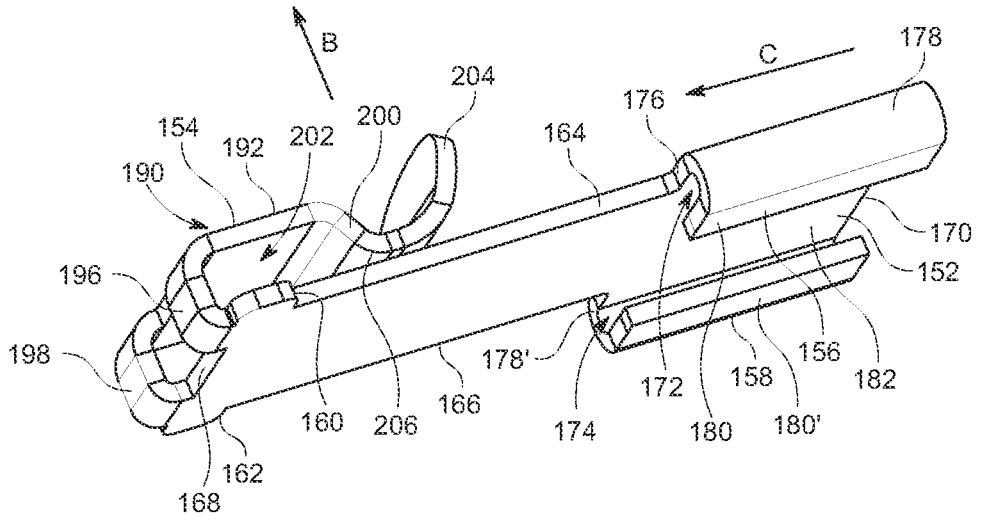
FIG. 7 a bottom perspective view of the clamping member, according to an embodiment of the disclosure.
Figure 8:
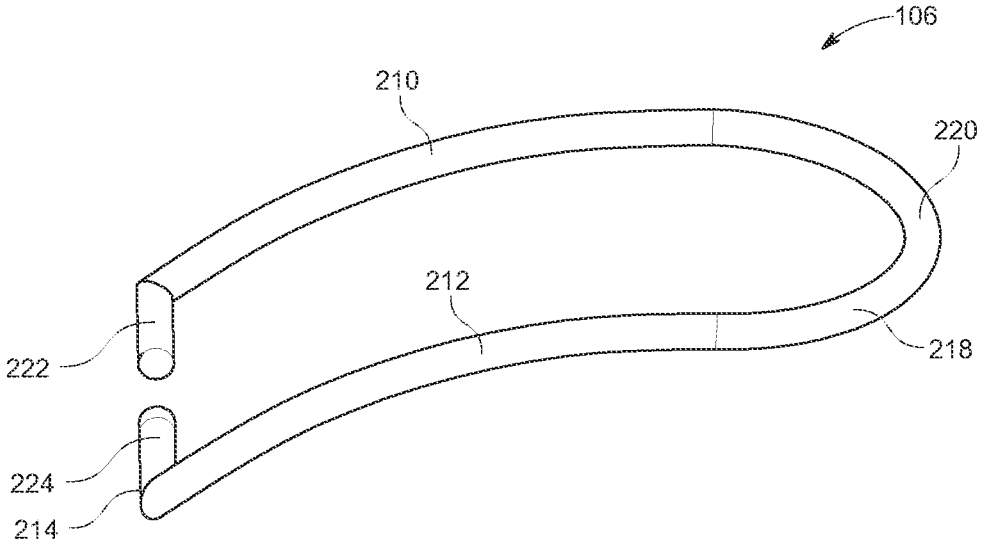
FIG. 8 depicts a perspective view of a clip member of the retainer assembly, according to an embodiment of the disclosure.

The pair of wings 156, 158 facilitates the engagement of the clamping member 104 with the base member 102 and supports the base member 102. As best shown in FIG. 3, the base member 102 extends through a pair of elongated channels 172, 174 defined by the pair of wings 156, 158. As such, referring to FIG. 7, a first wing 156 of the pair of wings 156, 158 is arranged along a first longitudinal side 164 of the base plate 152, while a second wing 158 of the pair of wings 156, 158 is arranged opposite to the first wing 156 and is arranged along a second side 166 of the base plate 152. In an embodiment, as best shown in FIG. 7, the first wing 156 includes a first straight portion 176, a bent portion 178, and a second straight portion 180 disposed substantially parallel and spaced apart for the first straight portion 176. The bent portion 178 is arranged between the first straight portion 176 and the second straight portion 180 and extends downwardly of the bottom plate 152. Accordingly, the second straight portion 180 is arranged underneath the first straight portion 176 and facing a second surface 182 of the base plate 152, and defines a first elongated channel 172 of the pair of elongated channels 172, 174 therebetween. As shown, the first elongated channel 172 extends along an entire length of the first wing 156, and is adapted to receive the plate of the base member 102.

Similarly, the second wing 158 includes a first straight portion 176', a bent portion 178', and a second straight portion 180' disposed substantially parallel and spaced apart for the first straight portion 176'. The bent portion 178' is arranged between the first straight portion 176' and the second straight portion 180' and extends downwardly of the bottom plate 152. Accordingly, the second straight portion 180' is arranged underneath the first straight portion 176', facing the second surface 182 of the base plate 152, and defines a second elongated channel 174 of the pair of elongated channels 172, 174 therebetween. As shown, the second elongated channel 174 extends along an entire length of the second wing 158, and is adapted to receive the plate of the base member 102. As the base member 102 (i.e. the plate 108) extends through the elongated channels 172, 174 of the wings 156, 158, and therefore, the wings 156, 158 act as guide structures facilitating the sliding of the clamping member 104 relative to the base member 102 and the retention of the base member 102 with the clamping member 104.

Further, the clasp 154 is arranged at the second longitudinal end 168 and includes a retention structure 190 having a cover portion 192 arranged spaced apart and facing a first surface 194 of the base plate 152, at least one connecting arm, for example, a first connecting arm 196 and a second connecting arm 198, extending from the bottom plate 152 to the cover portion 192 and connecting the cover portion 192 to the base plate 152, and a wall portion 200 arranged opposite to the connecting arms 196, 198 and extending downwardly towards the first surface 194 from the cover portion 192. Accordingly, the retention structure 190 includes a substantially inverted U-shaped channel 202 to receive the clip member 106 and facilitates a retention of the clip member 106 with the clasp 154. Further, in an embodiment, a bottom end 206 of the wall portion 200 may be arranged at distance from the first surface 194 of the base plate defining a gap therebetween. Alternatively, the bottom end 206 of the wall portion 200 may contact the first surface 194 of the base plate 152.

To facilitate an entry and exit of the clip member from the inverted U-shaped channel 202, the retention structure 190 is flexed upwardly relative to the base plate 152 to define a gap between wall portion 200 and the base plate 152. In an implementation, the retention structure 190 may be flexed relative to the base plate 152 by pulling the wall portion 200 in an upward direction 'B'. In an embodiment, to facilitate a movement of the wall portion 200 in the upward direction 'B', the retention structure 190 may include a tab 204 extending at an inclination relative to the wall portion 200 and defines an obtuse angle therebetween. The tab 204 is connected to the bottom end 206 of the wall portion 200 and extends upwardly and away from the base plate 152. A user may pull the tab 204 in a direction 'C' towards the second longitudinal end 168 to flex the retention structure 190, and hence to move the wall portion 200 upwardly to increase the gap between the wall portion 200 and the base plate 152 to facilitate an entry of the clip member 106 inside the inverted U-shaped channel 202.

Referring to FIGS. 2, 3, 4 and 8, the clip member 106 includes substantially hoop structure and may include a pair of rods 210, 212 extending longitudinally from a first end 214 of the clip member 106 to a second end 218 of the clip member 106. As shown in FIGS. 2 to 4, the rods 210, 212 extend along a length of the base member 102 from the first longitudinal end 110 to the second longitudinal end 112. As shown, the pair of rods 210, 212 includes a first rod 210 and a second rod 212 disposed spaced apart and extending substantially parallel to the first rod 210. In an embodiment, each of the rods 210, 212 includes a convex shape and defines a space between the clamping member 104 and the rods 210, 212 to receive the knot of the shoelaces therebetween. Further, the clip member 106 includes an arm 220 arranged at the second end 218 and connecting the first rod 210 to the second rod 212. The arm 220 extends from the first rod 210 to the second rod 212 and may be a curved/arcuate arm. Although, the arm 220 is contemplated as the curved arm, it may be appreciated that the arm 220 may be a straight arm connecting the first rod 210 to the second rod 212.

As shown in FIGS. 2 and 3, in an engaged position of the clip member 106 with the clasp 154, the arm 220 is arranged inside the inverted U-shaped channel 202 abutting the wall portion 200. Moreover, the clip member 106 may include a pair of pins, for example, a first pin 222 and a second pin 224, disposed at the first end 214 and arranged inside the engagement structures 132, 134 in an assembly of the clip member 106 with the base member 102. As shown in FIGS. 2, 3, 4, and 8, the first pin 222 extends from the first rod 210 in a lateral direction towards the second rod 212, while the second pin 224 extends from the second rod 212 towards the first rod 210. Accordingly, the first pin 222 and the second pin 224 are arranged between the first rod 210 and the second rod 212. In an assembly, as shown in FIGS. 2 to 4, the first pin 222 and the second pin 224 are disposed inside the first engagement structure 132 and the second engagement structure 134, respectively, and facilitates the pivotal connection of the clip member 106 with the base member 102. In embodiments, free ends of the pin 222, 224 may abut and engage with each other to prevent a removal of pins 222, 224 from the holes 136, 138. In some other implementations, each of the pins 222, 224 may include a bent portion arranged inside a gap defined between the pins 222, 224 and abut with respective cylindrical bodies of the engagement structures 132, 134 to lock the pins 222, 224 with the engagement structures 132, 134, and prevent a removal of the pins 222, 224 from the respective hole 136, 138.

Figure 9:
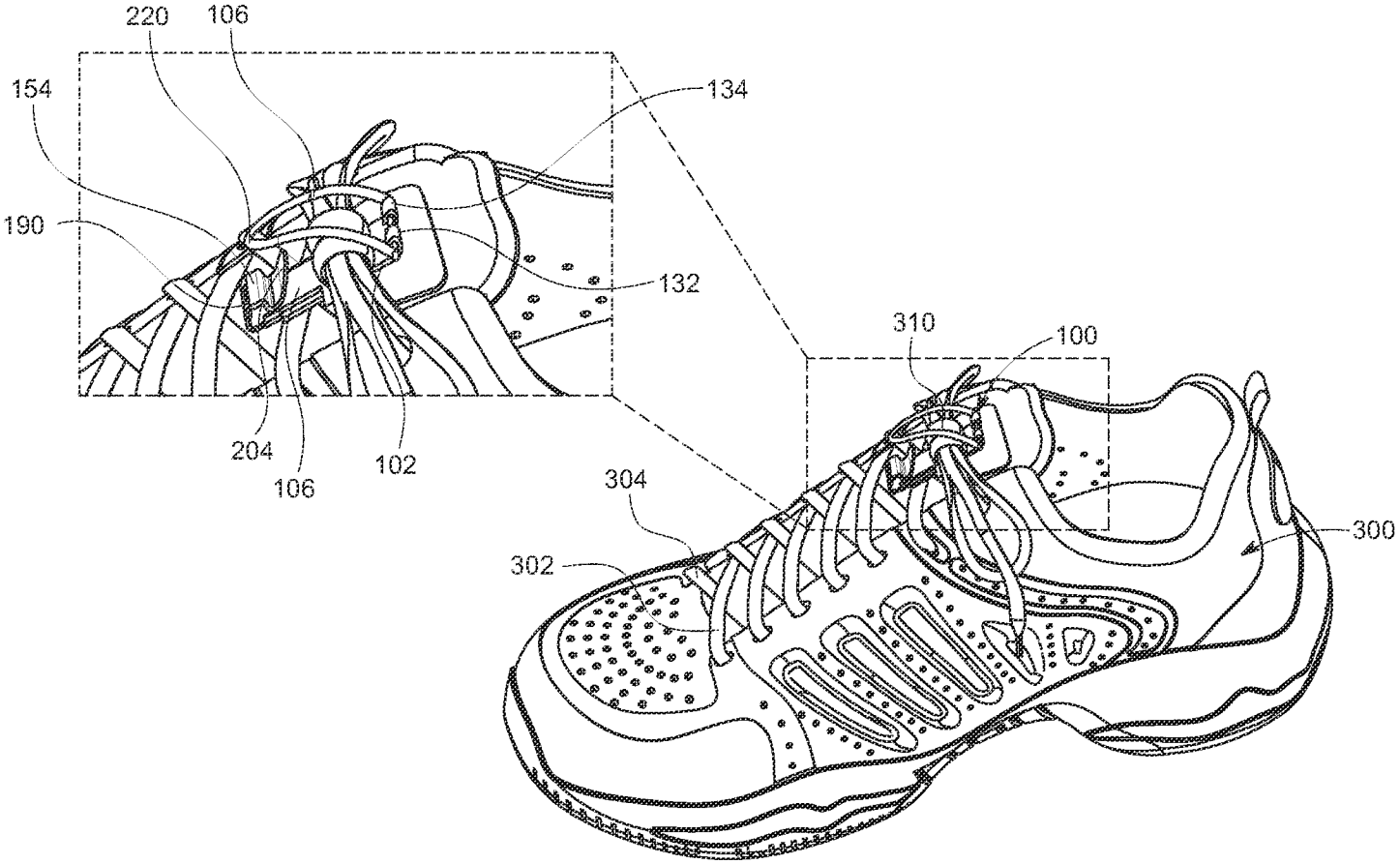
FIG. 9 depicts a side view of the retainer assembly engaged with the show and illustrating the clamping member arranged beneath the knot and the clip member arranged above the knot and disposed in a disengaged position, according to an embodiment of the disclosure.

A method of engaging the retainer assembly 100 to the knot 310 of the pair of shoelaces 302, 304 of the shoe 300 is now described. For securing the knot 310 with the retainer assembly 100, the clip member 106 is removed from the retention structure 190 and is moved to a disengaged position (as shown in FIG. 4). For so doing, the clamping member 104 is moved to the extended position by sliding the clamping member 104 relative to the base member 102. Thereafter, the retainer assembly 100 is engaged with the shoe 300 (as shown in FIG. 9). For so doing, the base member 102 along with the clamping member 104 is positioned underneath the knot 310 such that the engagement structures 132, 134 are disposed on one side, for example, a rear side, of the knot 310, whereas the clasp 154 of the clamping member 104 is arranged other side, for example, a front side, of the knot 310. Accordingly, as shown in FIG. 9, the knot 310 may be arranged above the base plate 152 and/or the wings 156, 158 of the clamping member 104.

Figure 10:
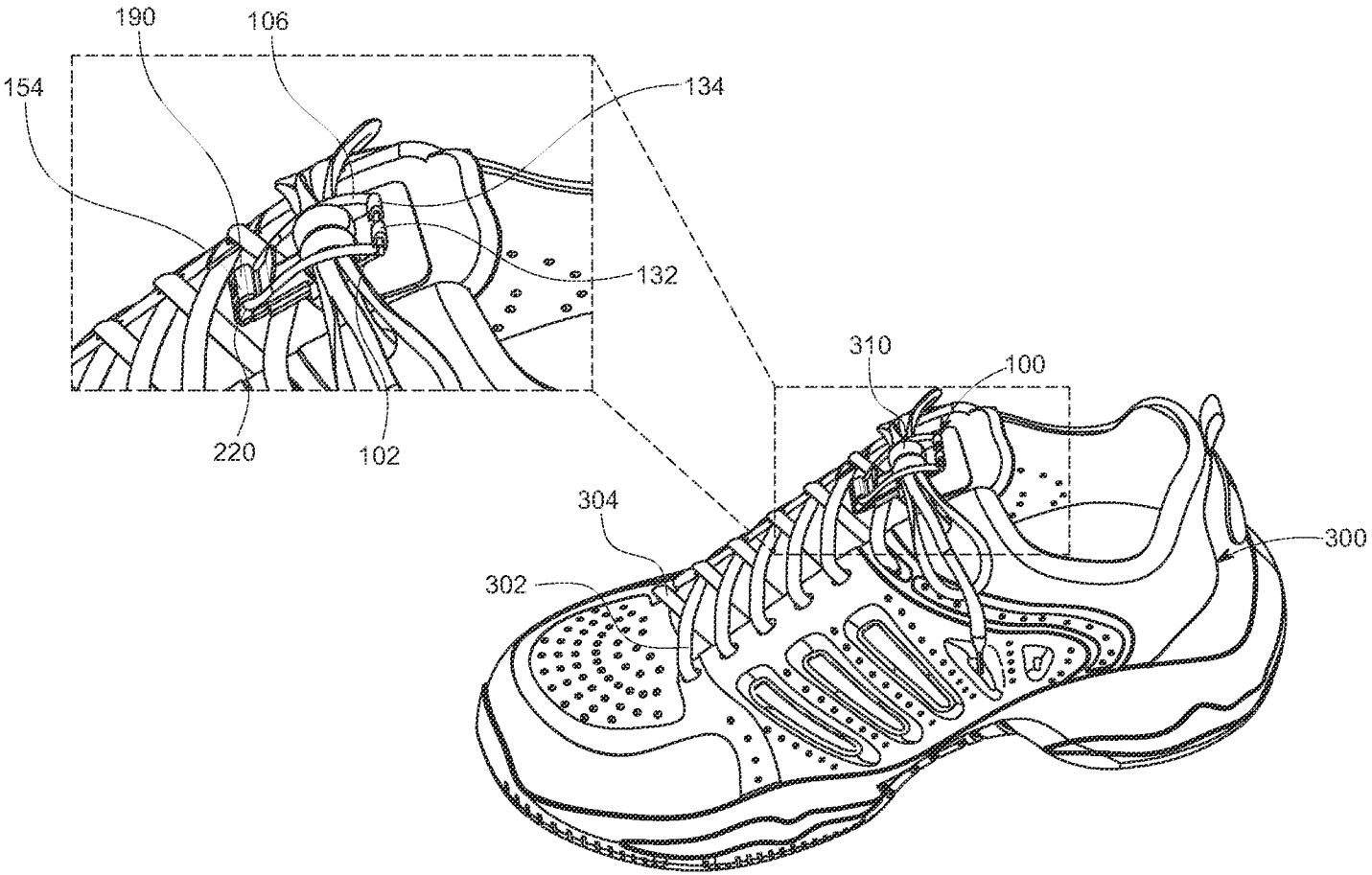
FIG. 10 depicts the retainer assembly attached to the knot with the clip member engaged to a clasp of the clamping member, according to an embodiment of the disclosure.

Thereafter, the clip member 106 is pivoted about the central axes 140, 142 to position the clip member 106 over/above the knot 310 such that pair of rods 210, 212 contacts the knot 310. Accordingly, As shown in FIG. 9, the knot 310 is sandwiched/secured between the base plate 152 and the pair of rods 210, 212, and the arm 220 is arranged proximate to the tab 204. Subsequently, the user moves the clamping member 104 to the retracted position by holding the clasp 154. In so doing, a force is applied on the tab 204, causing the tab 204 to move in the direction 'C', resulting in the flexing of the retention structure 190 and upward movement of the wall portion 200 in the direction 'B'. Accordingly, the arm 220 of the clip member 106 enters the inverted U-shaped channel 202 through the gap created between the base plate 152 and the bottom end of the wall portion 200 due to a lifting of the wall portion 200. In this manner, the arm 220 is secured inside the retention structure 190 and is engaged with the retention structure 190 (as shown in FIG. 10). Accordingly, the retainer assembly 100 is engaged with the knot 310 and secures the knot 300 and prevents/restricts the untying of the knot 310.

For disengaging the retainer assembly 100 from the knot 310, the clamping member 104 is moved to the retracted position by holding the clasp 154. In so doing, the clip member 106 moves out of the inverted U-shaped channel 202, and hence, the clip member 106 is disengaged from the retention structure 190. Thereafter, the clip member 106 is moved to the disengaged position by pivoting the clamping member 104 about the central axes 140, 142. Subsequently, the clamping member 104 along with the base member 102 is slid out from underneath the knot 310. Accordingly, the retainer assembly 100 can be engaged or disengaged from the knot 310 in easy and fast manner and retains the knot together. Further, as the retainer assembly 100 is lightweight and small in size, the retainer assembly does not hinder in the movement of the user.

Figure 11B:
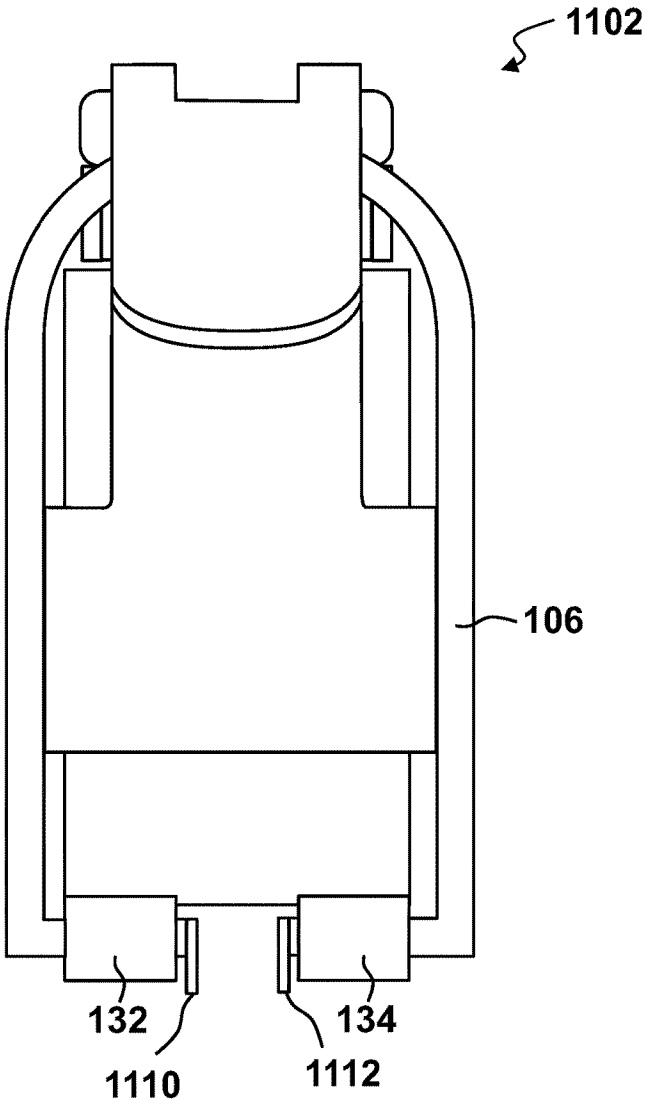
FIG. 11B depicts a top view of a retainer assembly having a clip member secured with a bend between a first engagement structure and a second engagement structure, according to an embodiment of the disclosure.
Figure 11A:
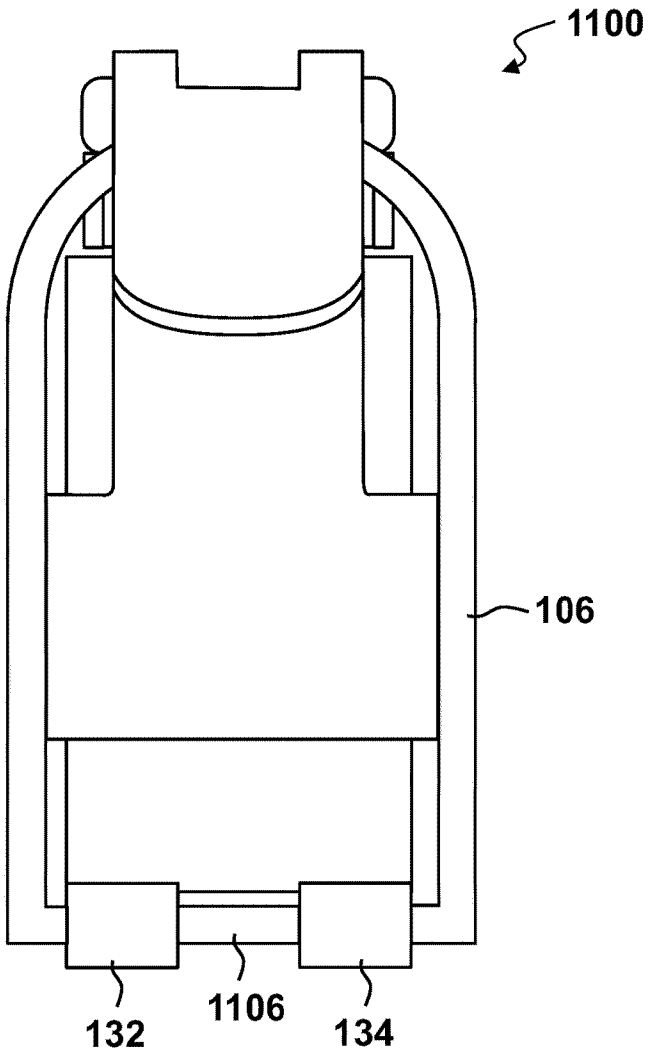
FIG. 11A depicts a top view of a retainer assembly having a clip member connected between a first engagement structure and a second engagement structure, according to an embodiment of the disclosure.

FIG. 11A depicts a top view of a retainer assembly 1100 having a clip member 106 connected 1106 between a first engagement structure 132 and a second engagement structure 134, according to an embodiment of the disclosure. The clip 106 may be connected 1106 so as to prevent the clip 106 from being detached from the retainer assembly by being pulled out from the first engagement structure 132 and/or the second engagement structure 134.

FIG. 11B depicts a top view of a retainer assembly 1102 having a clip member secured 106 with a bend 1110, 1112 between a first engagement structure 132 and a second engagement structure 134, according to an embodiment of the disclosure. A first bend 1110 proximate the first engagement structure 132 may prevent the clip member 106 from being detached from the first engagement structure 132. A second bend 1110 proximate the second engagement structure 134 may prevent the clip member 106 from being detached from the second engagement structure 134.

Figure 12B:
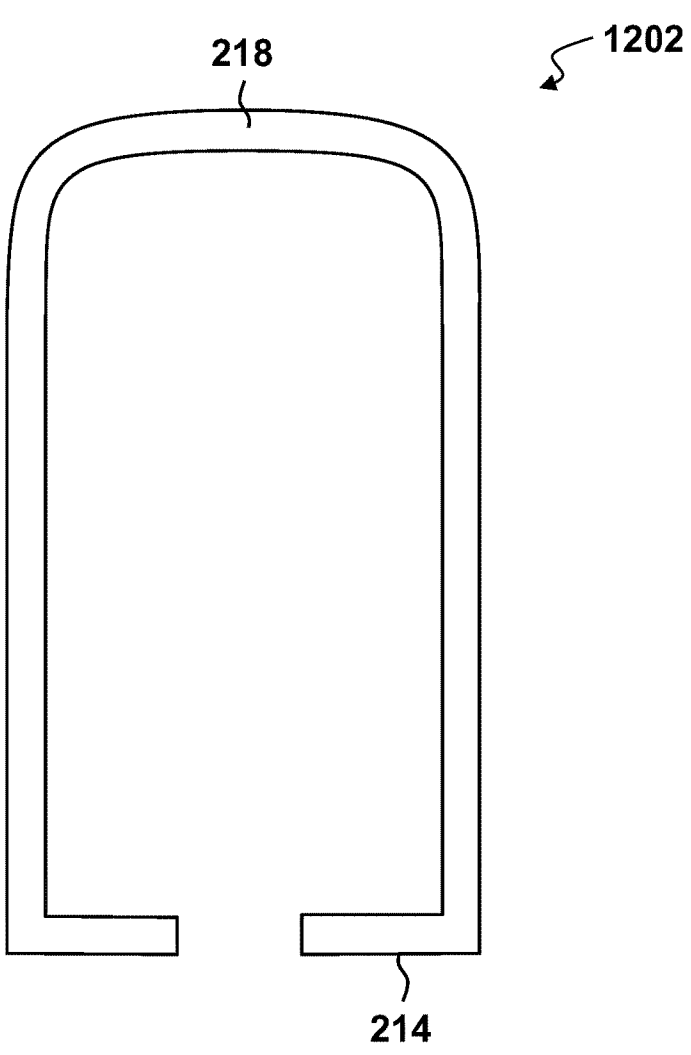
FIG. 12B depicts a perspective view of a clip member of the retainer assembly having a more squared second end as compared to FIG. 12A, according to an embodiment of the disclosure.
Figure 12A:
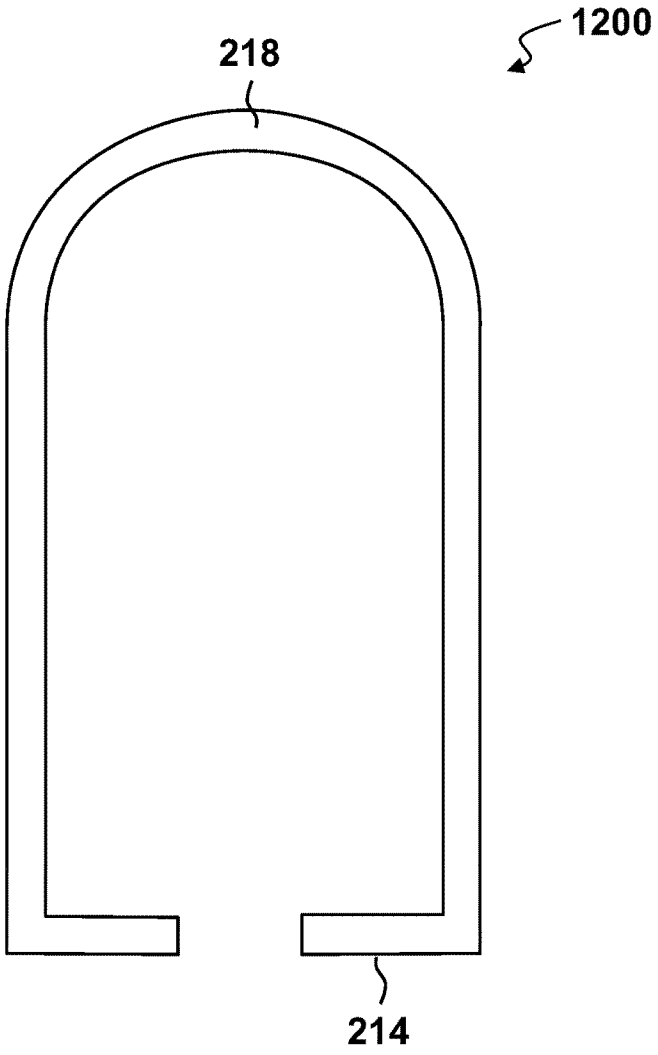
FIG. 12A depicts a top view of a clip member of the retainer assembly having a rounded second end, according to an embodiment of the disclosure.

FIG. 12A depicts a top view of a clip member 1200 of the retainer assembly having a rounded second end 218, according to an embodiment of the disclosure. The second end 218 may be distal from the first end 214, where the first end 214 is secured to the engagement structures (132, 134, FIGS. 11A-11B). In some embodiments, the second end 218 may be curved so as to allow for easier attaching and detaching of the second end 218 of the clip member 1200 to the substantially inverted U-shaped channel (202, FIG. 4).

FIG. 12B depicts a perspective view of a clip member 1202 of the retainer assembly having a more squared second end 218 as compared to FIG. 12A, according to an embodiment of the disclosure. In some embodiments, the second end 218 may be more squared so as to provide a stronger hold to prevent inadvertent detaching of the second end 218 of the clip member 1200 from the substantially inverted U-shaped channel (202, FIG. 4). The more squared end 218 may be substantially straight so as to require a greater pull force to detach the second end 218 from the substantially inverted U-shaped channel (202, FIG. 4) as compared to a curved second end (218, FIG. 12A).

It is contemplated that various combinations and/or subcombinations of the specific features and aspects of the above embodiments may be made and still fall within the scope of the invention. Accordingly, it should be understood that various features and aspects of the disclosed embodiments may be combined with or substituted for one another in order to form varying modes of the disclosed invention. Further, it is intended that the scope of the present invention is herein disclosed by way of examples and should not be limited by the particular disclosed embodiments described above.

What is claimed is:

1. A retainer assembly for securing a knot defined by a pair of shoelaces of a shoe, the retainer assembly comprising:

a base member, wherein the base member includes a plate;

a clamping member engaged with the base member and adapted to telescopically move relative to the base member between an extended position and a retracted position, wherein the clamping member includes a clasp, a base plate, and a pair of wings extending outwardly of the base plate in a lateral direction, wherein each wing defines an elongated channel extending in a longitudinal direction to slidably receive the base member, and wherein the plate is supported by the wings and extending through the elongated channels; and a clip member pivotally coupled to the base member and adapted to engage with the clasp when the clamping member is arranged in the retracted position to secure the knot between the clip member and the clamping member.

2. The retainer assembly of claim 1, wherein the plate includes a first portion and a second portion having a width smaller than a width of the first portion.

3. The retainer assembly of claim 2, wherein the base member includes a pair of sidewalls extending outwardly from two longitudinal sides of the plate and arranged at least partially along the second portion, wherein the pair of sidewalls is adapted to contact the pair of wings to limit an extension of the clamping member relative to the base member.

4. The retainer assembly of claim 3, wherein the base plate is arranged between the pair of sidewalls, wherein the sidewalls restrict a movement of the base plate in the lateral direction.

5. The retainer assembly of claim 3, wherein the clamping member includes a pair of shoulders extending outwardly of the base plate in the lateral direction and adapted to contact the pair of sidewalls to limit a retraction of the clamping member relative to the base member.

6. The retainer assembly of claim 1, wherein the clasp include a retention structure connected to the base plate and adapted to flex relative to the base plate, wherein the clasp defines an inverted U-shaped channel to receive the clip member in the engagement of the clip member with the clamping member.

7. The retainer assembly of claim 6, wherein the retention structure includes a cover portion disposed spaced apart and substantially parallel to a first surface of the base plate, at least one connecting arm connecting the base plate to the cover portion, and a wall portion extending from the cover portion towards the base plate and adapted to flex in a vertical direction to facilitate an entry of the clip member inside the inverted U-shaped channel to enable the engagement of the clip member with the retention structure.

8. The retainer assembly of claim 7, wherein the clasp further includes a tab extending at an obtuse angle from the wall portion in a direction away from the base plate, the tab facilitates the flexing of the retention structure relative to the base plate.

9. The retainer assembly of claim 1, wherein the base member includes at least one engagement structure defining a laterally extending hole, and the clip member includes a pair of pins arranged inside the laterally extending hole to facilitate the pivotal coupling of the clip member relative to the base member.

10. The retainer assembly of claim 9, wherein the clip member includes a pair of longitudinally extending rods arranged spaced apart and substantially parallel to each other, and each of the pair of pin extends in a lateral direction from one rod towards another rod.

11. The retainer assembly of claim 10, wherein the clip member includes an arm connecting the pair of rods and adapted to engage with the clasp to facilitate the engagement of the clip member with the clamping member.

12. The retainer assembly of claim 10, wherein each rod includes a substantially convex shape.

13. A retainer assembly for securing a knot defined by a pair of shoelaces of a shoe, the retainer assembly comprising:

a base member including a plate and at least one engagement structure defining a laterally extending hole;

a clamping member engaged with the base member and adapted to telescopically move relative to the base member between an extended position and a retracted position, the clamping member includes a base plate, a pair of wings extending outwardly of the base plate in a lateral direction, wherein each wing defines an elongated channel extending in a longitudinal direction to slidably receive the plate and supports the plate, and a clasp connected to the base plate; and a clip member pivotally coupled to the base member and including a pair of pins arranged inside the hole to facilitate the pivotal coupling of the clip member relative to the base member, and an arm adapted to engage with the clasp when the clamping member is arranged in the retracted position to secure the knot between the clip member and the clamping member.

14. The retainer assembly of claim 13, wherein the base member includes a pair of sidewalls extending outwardly from two longitudinal sides of the plate, wherein the pair of sidewalls is adapted to contact the pair of wings to limit an extension of the clamping member relative to the base member.

15. The retainer assembly of claim 14, wherein the clamping member includes a pair of shoulders extending outwardly of the base plate in the lateral direction and adapted to contact the pair of sidewalls to limit a retraction of the clamping member relative to the base member.

16. The retainer assembly of claim 13, wherein the clasp includes a retention structure connected to the base plate and adapted to flex relative to the base plate, wherein the clasp defines an inverted U-shaped channel to receive the arm in the engagement of the clip member with the clamping member.

17. The retainer assembly of claim 16, wherein the retention structure includes a cover portion disposed spaced apart and substantially parallel to a first surface of the base plate, at least one connecting arm connecting the base plate to the cover portion, and a wall portion extending from the cover portion towards the base plate and adapted to flex in a vertical direction to facilitate an entry of the arm inside the inverted U-shaped channel to enable the engagement of the clip member with the retention structure.

18. The retainer assembly of claim 17, wherein the clasp further includes a tab extending at an obtuse angle from the wall portion in a direction away from the base plate, the tab facilitates the flexing of the retention structure relative to the base plate.

19. The retainer assembly of claim 13, wherein the clip member includes a pair of longitudinally extending rods arranged spaced apart and substantially parallel to each other, wherein each of the pair of pins extends in a lateral direction from one rod towards another rod and the arm connects the pair of rods and is arranged spaced apart and opposite to the pair of pins.

* * * * *